United States Patent [19]

Sassier

[11] Patent Number: 4,760,886

[45] Date of Patent: Aug. 2, 1988

[54] FAST DISCHARGE FIRE EXTINGUISHER AND A METHOD OF FABRICATING SAME

[75] Inventor: Pierre Sassier, Bercheres sur Vesgre, France

[73] Assignee: Thomson-CSF, Paris, France

[21] Appl. No.: 878,439

[22] Filed: Jun. 25, 1986

[30] Foreign Application Priority Data

Apr. 25, 1986 [FR] France ..... 86 06024

[51] Int. Cl.[4] ..... A62C 35/02; A62C 35/08

[52] U.S. Cl. ..... 169/28; 159/35

[58] Field of Search ..... 169/28; 137/68.2; 169/35, 39, 71, 26, 36

[56] References Cited

U.S. PATENT DOCUMENTS

| | | | |
|---|---|---|---|
| 767,902 | 8/1904 | Libbey | 169/28 |
| 1,297,172 | 3/1919 | Hughes | 169/28 |
| 2,712,881 | 6/1955 | Mathisen | 169/28 |
| 2,795,202 | 6/1957 | Mathisen | 169/28 |
| 3,833,063 | 9/1974 | Williams | 169/28 |
| 4,637,472 | 1/1987 | Decima | 169/28 |

FOREIGN PATENT DOCUMENTS

| | | |
|---|---|---|
| 1143458 | 1/1953 | France . |
| 2565495 | 6/1984 | France . |

*Primary Examiner*—Galen Barefoot
*Assistant Examiner*—Lynn M. Fiorito
*Attorney, Agent, or Firm*—Pollock, VandeSande & Priddy

[57] ABSTRACT

A fire extinguisher with high speed discharge is provided comprising a container containing an inhibiting liquid which vaporizes when it is expanded and a pressurized gas such as nitrogen. A cover closes the container. An explosive charge tears the cover by a shock wave; it is disposed in the neighborhood of this cover at the end of a pyrotechnical stick coaxial with the container with one end fixed to the bottom thereof. The stick is secured to the side wall of the container by means of a support piece disposed in the vicinity of the opening of the container. This support piece centers the explosive charge along the axis of the container.

9 Claims, 2 Drawing Sheets

FIG_3-a

FIG_3-b

FIG_3-c

FIG_3-d

FAST DISCHARGE FIRE EXTINGUISHER AND A METHOD OF FABRICATING SAME

BACKGROUND OF THE INVENTION

1. Field of the Invention

The invention relates to a fast discharge fire extinguisher.

A fire extinguisher usually comprises a container containing an inhibiting body, for example in liquid form, such as freon or halon which is vaporized when it is expanded, as well as a gas, usually nitrogen, under a pressure of several tens of bars. This container is closed by a cover which is torn when the charge of a detonator explodes. This explosion is often set off automatically when a fire outbreak has been detected, for example by means of an infrared and/or ultraviolet detector.

The vaporized freon or halon opposes the fire by its high inhibiting power, reducing to a substantially zero value the chemical reaction of combustion.

In some cases, particularly when the product to be protected is likely to be consumed rapidly or is of the explosive type, it is desirable for the fire extinguisher to act as rapidly as possible after detection, that is to say that the detonator must explode as rapidly as possible and empty the container in the shortest possible time.

2. Description of the Prior Art

In French patent No. 8409034 in the name of ABG-SEMCA, a fire extinguisher of this type has been described in which the detonator, which acts by shock wave, is disposed inside the container, at the first end of a pyrotechnical stick which extends along the axis of the container and whose second end is secured to the bottom. Furthermore, in this fire extinguisher in the neighborhood of the outlet opening, the container has a shape such that the particular pressure losses are minimized. So as not to disturb the discharge, no obstacle is provided in the neighborhood of this outlet opening which might oppose the out-flow of the liquid.

The invention provides a fire extinguisher with high speed discharge having the same qualities of speed of discharge as those of the French patent but whose cost is substantially lower.

SUMMARY OF THE INVENTION

The fire extinguisher of the invention comprises (in a way known per se, see French Patent No. 8409034): a container which contains an inhibiting liquid which vaporizes when it is expanded and a pressurized gas, a cover closing the container which is perpendicular to the axis of the container, and an explosive charge disposed at the end of a pyrotechnical stick extending along the axis of the container, this charge being inside the container close to the cover and acting by shock wave along the axis, the container having a form, near to its outlet, for minimizing pressure losses. This fire extinguisher is characterized in that the pyrotechnical stick bears, for example through radial arms, against an internal wall of the narrowed outlet end of the container. The portion of the stick bearing on the container further centers the charge along the axis. At the other end the pyrotechnical stick is secured to the bottom of the container.

In the prior patent, the pyrotechnical stick also bears against the internal surface of the side wall of the container but this bearing relation is situated in the part of the container having the largest diameter.

The advantage which results from the arrangement of the invention is that the supporting piece or portion has substantially smaller dimensions than in the prior patent, which reduces the manufacturing cost and especially, as will be seen hereafter, allows the technique called "extrusion" for fabricating the container and omitting welding inside this container.

Up until now, it has been thought that disposing a support piece, particularly radial arms, in the outlet zone of the container at this position increased the pressure losses and thus discharge time. But it has been observed that the discharge time remains practically the same as in the construction where the support piece was very far removed from the outlet zone of the container. This result is due to the fact that the position of the support piece practically at the end of the pyrotechnical stick improves centering of this stick. Thus the explosive charge will reliably act along the axis, that is to say symmetrically, which is a factor reducing the discharge time compensating for the increase in discharge time caused by the increase in pressure losses.

With the invention, the discharge time is from 35 to 40 milliseconds from the detection of a fire, substantially as in the construction described in French Patent No. 8409034; but the fabricating cost is appreciably lower.

BRIEF DESCRIPTIONS OF THE DRAWINGS

Other features and advantages of the invention will be clear from the description of certain embodiments, with reference to the accompanying drawings in which:

FIG. 1 is a diagram in axial section of a fire extinguisher comprising the improvement of the invention, FIG. 2 is the perspective view of one element of the fire extinguisher of FIG. 1, and FIGS. 3*a*, 3*b*, 3*c* and 3*d* show steps for fabricating the container of the fire extinguisher of FIG. 1.

DESCRIPTION OF THE PREFERRED EMBODIMENT

Figure 1:
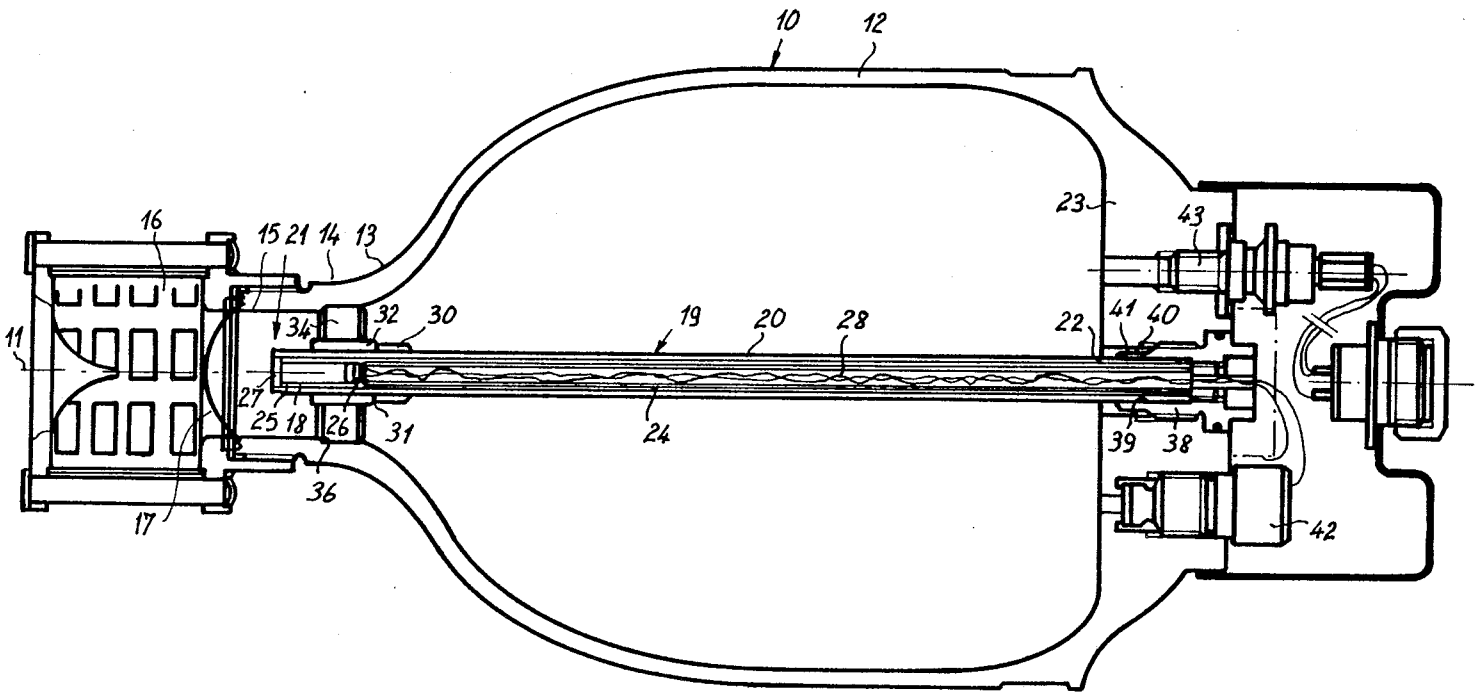

In the example, the high speed discharge fire extinguisher is intended to be installed in a place where explosive charges are stored. The detection of a fire outbreak is made by an infrared and/or ultraviolet radiation sensor which controls the high speed discharge of the freon as soon as the fire has been detected.

This fire extinguisher comprises a metal container 10 charged with liquid freon and nitrogen at a pressure of the order of 60 bars. Container 10 is, as will be seen further on, in connection with FIGS. 3*a* to 3*d*, fabricated by the extrusion technique.

It has a general shape of revolution about an axis 11. Its central part 12 is formed by a cylinder whereas its front part, or neck 13, has a section which narrows as far as the opening 14. In the immediate vicinity of this opening 14, container 10 has another cylindrical section 15 threaded externally for receiving a diffuser 16.

Immediately behind the cylindrical section 15, neck 13 has, in section through a plane passing through the axis 11, the shape of an arc of a circle with its center disposed inside a container. This shape is favorable for minimizing particular pressure losses (the pressure losses due to the shape), which maximizes the outflow of the freon (and so minimizes the discharge time).

Opening 14 is closed by a cover 17 formed by a membrane which is torn when an explosive charge 18 bursts. The charge 18 is disposed inside container 10 in the vicinity of this cover 17.

Charge 18 is of the type producing a detonation, that is to say a charge which explodes with a shock wave moving at a speed greater than that of sound. This charge 18 contains for example lead azide. The charge 18 is at the front end of pyrotechnic stick 19 formed of a tube 20 (with axis 11) extending over practically the whole length of container 10. The tube 20 has a front end 21, where the charge 18 is located, at the level of cylindrical section 15 and a rear end 22 which passes through the bottom 23 of the container.

The pyrotechnical stick 19 further includes another tube 24, housed in tube 20, and which is coaxial therewith. The length of the tube 24 is equal to that of tube 20 reduced by the length of charge 18. The diameter of tube 24 is practically equal to that of charge 18. The charge 18 is housed in a chamber 25 at the end 21 of tube 20 which is defined, perpendicular to axis 11, on the one side by an end 26 of the inner tube 24 and on the other side by the front end 21 closing tube 20. Charge 18 occupies practically the whole volume of this chamber 25.

Tube 24 contains the electric conductors 28 which connect the charge 18 to an ignition system associated with a detector outside the container 10.

Figure 2:
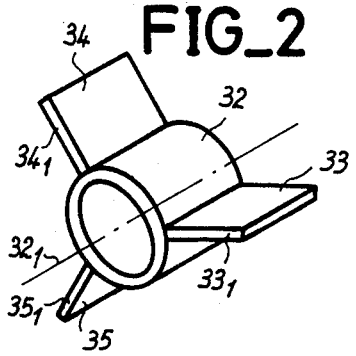
Figure 2:
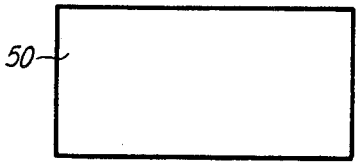
Figure 2:
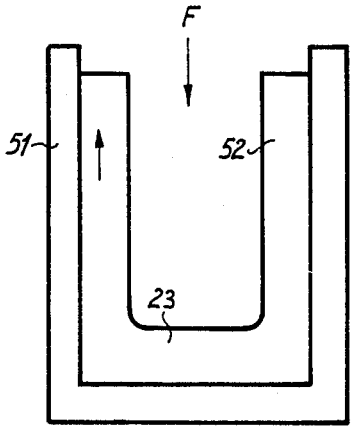
Figure 2:
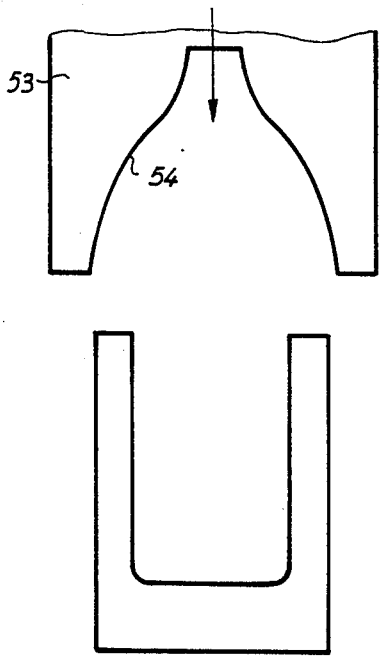
Figure 2:
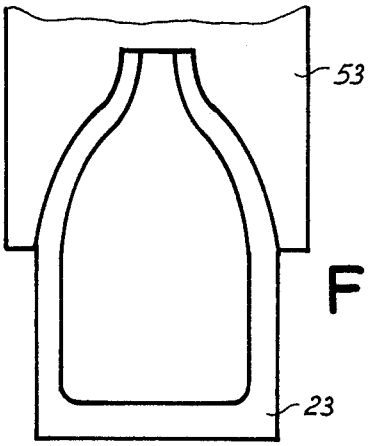

According to the invention, to support the pyrotechnical stick 19 in the vicinity of the front end 21, tube 20 is provided on its outer face with a thickened portion 30 which ends forwardly, that is to say towards the opening of the cylinder, in a shoulder 31 forming a stop against which the rear end of a cylindrical ring 32 bears. Cylindrical ring 32 has an inner diameter slightly greater than the outer diameter of tube 20. Three radial arms 33, 34, and 35 (FIG. 2) project from ring 32 spaced evenly apart about axis 11, that is to say, the arms 32–35 form therebetween angles of 120°.

The thickened portion 30 of tube 20 is for example formed by a simple ring surrounding tube 20 and welded thereto.

The length of ring 32 is less than the length separating the shoulder 31 from the front end 21 of tube 20.

At their ends in the radial direction arms 33, 34 and 35 bear by their front edges $33_1$, $34_1$, and $35_1$ against a shoulder 36 formed in the inner face of the container 10 in its cylindrical part 15 in the neighborhood of the opening.

So that ring 32 with its arms 33, 34, 35 may be fitted into container 10 through the opening of cylindrical section 15, by presenting it with its axis $32_1$ perpendicular to axis 11, the axial length of this ring 32 is substantially less than the diameter of the internal surface of the cylindrical section 15.

The rear end 22 of tube 20 is fitted into a cylindrical opening 39 in a piece 38 screwed into a tapped hole 40 in bottom 23. The end of tube 20 is fixed to piece 38 by welding 41 the front end face of this piece 38 with a part of the external surface of end 22 of tube 20.

Furthermore bottom 23 has, in addition to piece 38 and a filling valve 42 forming at the same time a safety valve against over pressures as well as a pressure controller 43 for detecting pressure drops in container 10.

Container 10 is usually disposed with its axis 11 in the vertical position, the opening being directed downwardly for facilitating discharge of the inhibiting liquid.

The pyrotechnical stick is fitted inside container 10 in the following way:

Ring 32 is introduced, as mentioned above, through the opening of cylindrical section 15 by presenting it with its axis $32_1$ perpendicular to axis 11. Then this ring is turned around so that it takes up the position shown in FIG. 1 with its edges $33_1$, $34_1$ and $35_1$ resting by their radial ends against shoulder 36 of the internal surface of the container. Then the stick 19 is introduced through the bottom. Piece 38 is screwed into bottom 23. At the end of mounting shoulder 31 of tube 20 bears against the rear end of ring 32. Thus ring 32 is jammed between shoulder 31 and shoulder 36 (through the radial arms).

Because of the position of ring 32 in the vicinity of the opening in cylindrical section 15, the axis of tube 20 merges exactly with the axis 11 of container 10. Thus it is certain that the axis of the explosive charge 18 is accurately located along the axis 11 of the container. On the contrary, in the prior art construction, tube 20 bears radially in the center of container 10 which leaves between this radial bearing point and end 21 a considerable length which does not allow the explosive charge to be centrally positioned. The position of charge 18 along the axis minimizes the pressure losses and so minimizes the discharge time of the inhibiting liquid.

Furthermore, there is no need, as in the prior construction, to weld the radial arms 33, 34, 35 to the wall of the container. In addition, because of the relatively small size of the piece formed by ring 32 with its radial arms, it may be formed by molding and therefore at low cost.

Finally, container 10 is fabricated by the so called extrusion technique which is illustrated schematically in FIGS. 3*a* to 3*d*.

A cylindrical metal ingot 50 (FIG. 3*a*) is disposed in the bottom of a pot 51 and it is pressed with a press of a diameter less than the internal diameter of the pot so that the material may escape through the space between this press and the internal surface of the pot. Thus the bottom 23 is formed and a cylindrical surface 52 which forms the central part 12 of the container; this latter is then shaped at the end opposite the bottom 23 so as to give it an ogival shape (FIGS. 3*c* and 3*d*) so as to form the front opening including elements 13, 14, 15 of the container 10.

The ogival shape is obtained by means of another press 53 whose inner shape 54 corresponds to the shape described for the elements 13, 14, 15.

After the ogival shaping operation, the cylinder 10 is terminated by different machining operations of the bottom 23 and of the cylindrical section 15, particularly for external threading of the front end. The only internal machining is that required for forming the shoulder 36. This machining is for example a simple boring operation.

The extinguisher of the invention operates in the following way:

When a fire outbreak has been detected, a signal is transmitted to the charge for triggering it by the electric conductors 28. This charge 18 explodes and produces a shock wave which is propagated exactly along axis 11, perpendicularly to cover 17, which is then torn. Because of the nitrogen pressure the freon is rapidly discharged, in a time of the order of 35 to 40 milliseconds. The explosion causes vaporization of the freon.

As in the prior construction, minimization of the discharge time of the freon is promoted by the nature and position of charge 18 as well as by the shape of container 10. But, with respect to the prior construction, the better position of charge 18, obtained by means of ring 32 and its radial arms 33, 34 and 35 in the vicinity of the opening, further improves the speed of discharge by minimizing the pressure losses. A gain obtained by the better positioning of charge 18 compensates for the pressure loss caused by the presence of the radial arms 33, 34, 35 in the vicinity of the opening.

What is claimed is:

1. A fire extinguisher with high speed discharge including a container having generally cylindrical sidewalls, a bottom, and a narrowed outlet, said container containing an inhibiting liquid which vaporizes when it is expanded and a pressurized gas such as nitrogen, a cover closing the container, and an explosive charge for tearing the cover by a shock wave and which is disposed in the vicinity of the cover at first end of a pyrotechnical stick coaxial with the container with another end fixed to the bottom thereof, said stick secured to a side wall of the container by means of a support piece, wherein the support piece for the pyrotechnical stick is disposed in the narrowed outlet substantially near the first end of the stick of the container, this support piece further centering the explosive charge along the axis of the container.

2. The fire extinguisher as claimed in claim 1, wherein said support piece has a ring which surrounds said first end of the pyrotechnical stick situated in the vicinity of the opening of the container and from which project radial arms, these radial arms bearing by the ends of their edges directly towards the opening, against a shoulder or stop formed in the internal surface of the container.

3. The fire extinguisher as claimed in claim 2, wherein said ring bears, in the direction of the bottom of the container, by its rear end against a shoulder or stop formed in an outer surface of the pyrotechnical stick.

4. The fire extinguisher as claimed in claim 3, wherein the shoulder or stop formed in the outer surface of the pyrotechnical stick is at an end of another ring surrounding the stick and fixed thereto for example by welding.

5. The fire extinguisher as claimed in claim 3, or 4, wherein, so that said ring with its radial arms may be fitted into the opening of the container, this ring has an axial length substantially less than the internal diameter of the opening of the container.

6. The fire extinguisher as claimed in any one of claims 2 to 4, wherein said ring with its radial arms is formed as a one piece molding.

7. The fire extinguisher as claimed in any one of claims 1–4, wherein the explosive charge is disposed in a chamber in which it occupies substantially all the volume.

8. The fire extinguisher as claimed in any one of claims 1–4, wherein a rear part of this charge bears against a stop so that the shock wave produced by the explosion propagates especially forward.

9. The fire extinguisher as claimed in any one of claims 1 to 4, wherein, in the vicinity of its outlet opening, the container has a shape of revolution generated by the rotation about the axis of the container of an arc of a circle whose center is outside the container.

* * * * *